United States Patent [19]

Johnson

[11] 4,162,785

[45] Jul. 31, 1979

[54] MITER CLAMP

[76] Inventor: George P. Johnson, 1951 Hollywood Pkwy., York, Pa. 17403

[21] Appl. No.: 884,763

[22] Filed: Mar. 9, 1978

[51] Int. Cl.[2] ..... B25B 5/14

[52] U.S. Cl. ..... 269/41; 269/47; 269/244

[58] Field of Search ..... 269/41, 53, 54–54.3, 269/244, 265, 271, 279, 280, 283; 81/6

[56] References Cited

U.S. PATENT DOCUMENTS

| | | | |
|---|---|---|---|
| 831,486 | 9/1906 | Taft | 269/41 |
| 842,555 | 1/1907 | Johnson | 269/41 |
| 879,547 | 2/1908 | Holter | 269/41 |
| 949,096 | 2/1910 | Stetson | 269/41 |
| 1,222,204 | 4/1917 | Hansen | 269/41 |
| 1,359,597 | 11/1920 | Holman | 269/41 |
| 2,753,902 | 7/1956 | Klee | 269/41 |

FOREIGN PATENT DOCUMENTS

| | | | |
|---|---|---|---|
| 237815 | 4/1943 | Switzerland | 81/6 |

*Primary Examiner*—Robert C. Watson
*Attorney, Agent, or Firm*—Charles J. Long

[57] ABSTRACT

A clamp for exerting joining force perpendicular to the joint line of a miter joint includes first and second sets of parallel pins defining first and second planes respectively, each set comprising at least two pins, all the pins being substantially equal in length, the first plane being parallel to and co-extensive with the second plane, and means for applying force in a direction perpendicular to the two planes to move the first and second sets of pins toward each other. In a preferred embodiment, first and second members hold the first and second sets of pins respectively and a threaded cylindrical shaft passes through holes in the members; the hole in the first member is threaded to receive the shaft threads and the hole in the second member is unthreaded and just large enough for the shaft to rotate freely therein, the second member being fixed in axial position on the shaft. In such embodiment rotation of the shaft moves the first member axially along the shaft toward the second member.

1 Claim, 4 Drawing Figures

MITER CLAMP

BACKGROUND OF THE INVENTION

I. Field of the Invention

This invention relates to an improved miter clamp. More particularly, the invention relates to a miter clamp which exerts compressive joining force perpendicular to the joint line between two pieces forming a miter joint in a decorative picture frame or the like by engaging the two pieces from the unfinished or back side only, thereby eliminating the possibility of any unwanted marks on either the front or the edge of the frame members.

II. Description of the Prior Art

In fabricating picture frames and the like in which the ends of adjacent frame members are mitered to form right-angle corners, it is generally desirable to minimize or entirely avoid making marks in the front or outside edges of the frame members—i.e., the portions of the frame that are in view when the frame is hung on a wall. Thus the miter joints in many such assemblies are fastened with glue rather than with nails, which must be driven in from the outside edges of the joint members and are thereafter visible when the frame is hung on a wall.

As is well known, miter clamps are used to hold the mating surfaces of a glued miter joint tightly together while the glue therein sets or cures. For best results, the compressive joining force exerted by such clamps should act in a direction perpendicular to the mating surfaces which form the joint line; if the force is not so oriented, the joint members must be firmly held in position to prevent their slipping with respect to each other during the time the glue is setting.

Miter clamps of the prior art are of three general types. One type consists of an arrangement of adjustable supporting members which surround and firmly hold the entire frame being fabricated; an example of such a clamp is disclosed in U.S. Pat. No. 1,359,597. Such clamps are effective for holding a frame while the glue in miter joints is setting, and they generally do not mark the surface of the frame, but they are bulky and generally of complex construction, and are not practical where only a single joint is to be glued.

In a second type of clamp two frame members forming a miter joint are held in place in two channels, each of which has a fixed side wall and a movable side wall; the position of the latter is adjustable both to handle frame members of various widths and to firmly secure the member being glued in position against its mating member. The principal disadvantage with this type of clamp is that it does not exert joining force in a direction perpendicular to the joint line; rather, the forces exerted are parallel to the long axes of the members being glued, such that optimum conditions for a strong joint are not obtained.

The third type of prior art miter clamp is exemplified by U.S. Pat. Nos. 842,555 and 949,096. In this type of clamp, adjustable pivoted arms engage the outer edges of the two pieces forming a miter joint; joining force is exerted by turning a screw which tends to force the arms together. The joint members are prevented from slipping out of the arms by means of pins or serrated surfaces which dig into the edge of such members. Such pins or serrated surfaces give rise to the principal disadvantage of this third type of clamp, namely, they mark or scar the outer edge surfaces of the frame members, and thus detract from the appearance of the finished frame.

SUMMARY OF THE INVENTION

The miter clamp of my invention is light weight, easy to use, and suitable for miter joints in a wide range of sizes; it exerts joint force perpendicular to the joint line and causes no marks on either the edges or the front surfaces of the pieces being joined, and is thus particularly suitable for decorative picture frames and the like.

In accordance with the invention, I provide a clamp for exerting joining force perpendicular to the joint line of a miter joint, comprising first and second sets of parallel pins defining first and second planes respectively, each set comprising at least two pins, all the pins being substantially equal in length, the first plane being parallel to and co-extensive with the second plane, and means for applying force in a direction perpendicular to the two planes to move the first and second sets of pins toward each other.

In a preferred embodiment, the force applying means comprises first and second members holding the first and second sets of pins respectively, each member defining a circular hole whose axis is perpendicular to the plane of its set of pins, a cylindrical shaft passing through the holes in the first and second members, and means for causing the first and second members to move toward each other along the axis of the shaft.

In a further preferred embodiment, the shaft is threaded, the hole in the first member is threaded to receive the shaft threads and the hole in the second member is unthreaded and just large enough for the shaft to rotate freely therein, and the second member is fixed in axial position on the shaft, whereby rotation of the shaft moves only the first member axially therealong while the axial position of the second member on the shaft remains fixed.

Preferably, each set of pins consists of two pins.

In one embodiment, the pins are cylindrical in shape and the diameter of each pin is no more than one-third the diameter of the shaft.

BRIEF DESCRIPTION OF THE DRAWINGS

In the accompanying drawings I have shown a present preferred embodiment of the invention in which.

DESCRIPTION OF THE PREFERRED EMBODIMENT

Figure 1:
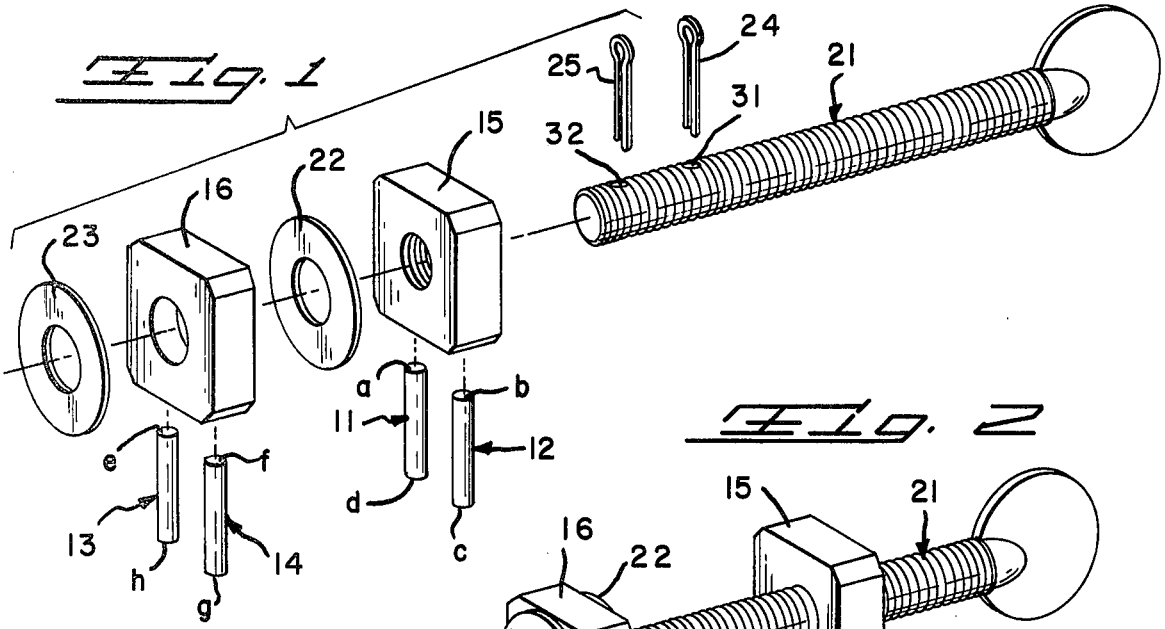
FIG. 1 is an exploded perspective view of a miter clamp of the type disclosed.
Figure 2:
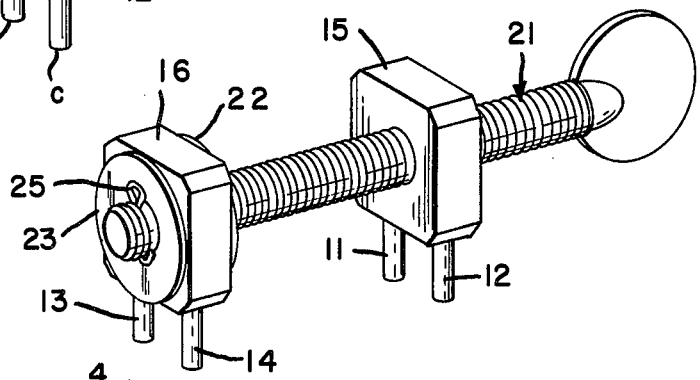
FIG. 2 is a perspective view of the miter clamp in fully assembled condition.

Turning first to FIGS. 1 and 2, it will be seen that the preferred clamp of my invention comprises a first set of parallel pins 11 and 12 defining a first plane designated abcd, and a second set of parallel pins 13 and 14 defining a second plane designated efgh. The pins are all substantially equal in length and are so positioned that the first and second planes are parallel and co-extensive. For ease in use of my clamp I prefer cylindrical pins, and I may, for example use pins having a diameter of one-eighth inch and a length of one-half inch. I prefer to use pins of hardened steel, but other materials would be suitable provided pins formed therefrom have suitably high shear strength.

Figure 4:
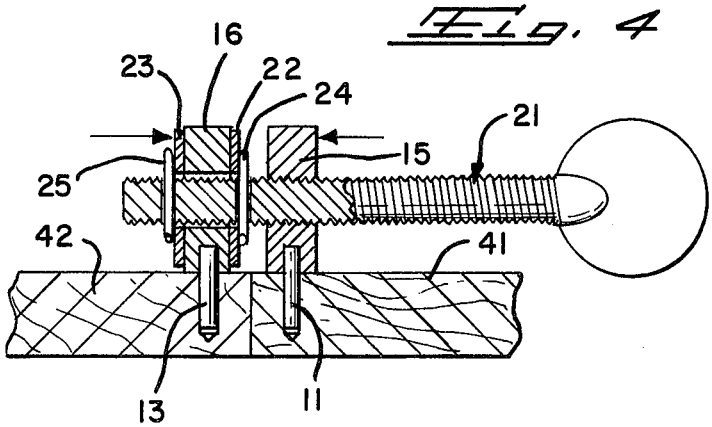
FIG. 4 is a cross-sectional view taken substantially along the line 4—4 of FIG. 3 and showing a miter joint held in tightly clamped position by the invention.

The first and second sets of pins are held respectively by members 15 and 16. The pins and the members holding them may be joined by welding the ends of the pins to the surface of the members holding them; however, for greater strength, I prefer to drill holes in the members for receiving the pins, as is shown in FIG. 4, and to secure the pins in the holes by brazing, soldering or the like.

Each of members 15 and 16 has a circular hole through its center, the axis of the hole being perpendicular to the plane defined by the pins held by the member.

A threaded cylindrical shaft, thumb screw 21, is received in the holes through the members 15 and 16. The hole in member 15 is threaded to mate with the threads on thumb screw 21, while the hole in member 16 is unthreaded and just large enough for the thumb screw to rotate freely therein. Member 16 is fixed in its axial position on the thumb screw 21 by means of washers 22 and 23 and cotter pins 24 and 25 inserted through holes 31 and 32 respectively which have been drilled through the body of thumb screw 21.

For best operation, I prefer that the diameter of pins 11, 12, 13 and 14 be no more than one-third the diameter of thumb screw 21. In one specific embodiment, I use one-eighth inch diameter pins and a one-half inch diameter thumb screw, although other combinations would serve equally well.

In general, I prefer to use steel, brass or similar metals for the various parts of my miter clamp; however, other materials having similar physical properties can no doubt be used satisfactorily.

Figure 3:
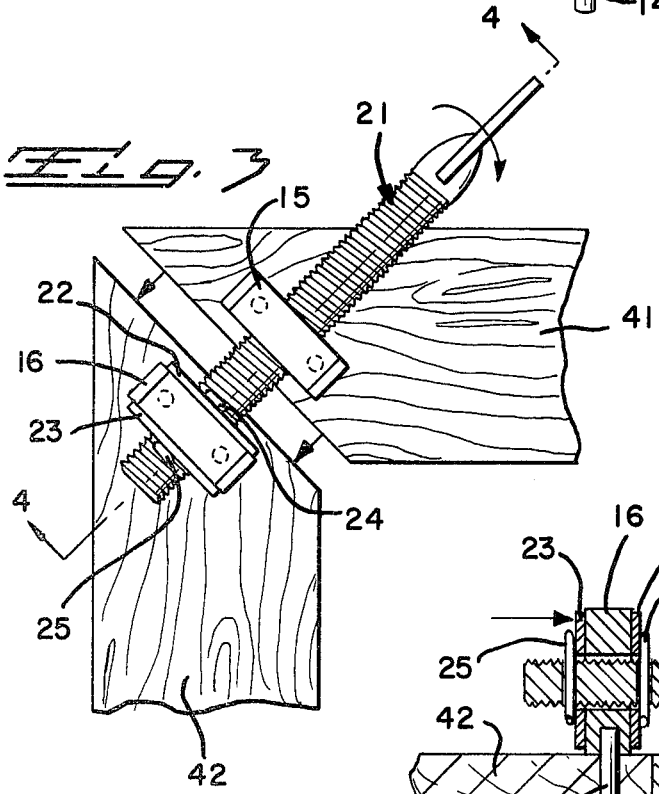
FIG. 3 is a top plan view of the miter clamp showing it applied to a partially clamped miter joint.

FIGS. 3 and 4 illustrate the use of the clamp of my invention with a wood miter joint being glued. In the figures, the two pieces forming the miter joint are designated generally as 41 and 42. To prepare the pieces for use of my clamp, I first drill two holes in the back side of piece 41 and two holes in the back side of piece 42; the holes in piece 41 are equidistant from the mitered end of the piece and the space between the holes is equal to the space between pins 11 and 12 of my clamp, and the holes in piece 42 are equidistant from the mitered end of that piece with the space between holes equal to the space between pins 13 and 14. In addition, the holes are positioned so that when pieces 41 and 42 are placed together in the desired position a line joining the hole for pin 11 with that for pin 13 is perpendicular to the abutting surfaces of the two pieces. The hole diameter should be just large enough to provide a snug fit for the pins to be inserted therein, and the hole depth should preferably be sufficient to accommodate the full length of the pins extending from the surfaces of members 15 or 16, as the case may be; in the event the thickness of the pieces being joined is less than the extending length of the pins, the holes should be drilled as deep as possible without going through the pieces to the front side thereof.

After the glue or other appropriate adhesive has been applied to the surfaces being joined, pins 11, 12, 13 and 14 are inserted in the holes as is indicated in FIG. 3. Thereupon, thumb screw 21 is rotated in the appropriate direction to move member 15 toward member 16; if thumb screw 21 has right-hand threads, such rotation is counterclockwise as shown in FIG. 3, whereas with left-hand threads on thumb screw 21 the appropriate direction of rotation would be clockwise. Rotation of thumb screw 21 moves member 15 axially therealong toward member 16, thereby bringing piece 41 into abutting relationship with piece 42, as shown in FIG. 4. Thereafter, slight additional rotation of thumb screw 21 exerts force tending to move members 15 and 16 and the pins associated therewith closer together, and thereby exerts joining force perpendicular to the joint line of the miter joint being glued. As above indicated, such force provides optimum joint strength and inherently prevents slipping of the joint members with respect to each other.

After the glue in the miter joint has set, thumb screw 21 is rotated slightly in the direction tending to move member 15 away from member 16, so as to relieve the compressive forces from the members and their associated pins. When such compressive forces are relieved, the clamp is pulled out of the holes in pieces 41 and 42 and is then ready for use with other miter joints.

As is evident from the foregoing, the miter clamp of my invention has special utility in gluing miter joints of decorative picture frames, because when used as intended it provides the joining force desired to hold the joint firmly while the glue therein sets, but does not cause any marks on either the front or the edge of the finished frame. When sized appropriately for picture frames of normal dimensions, the clamp is light weight and easy to fabricate, and its design makes it relatively easy to use as compared to some clamps of the prior art.

While I have shown and described a certain present preferred embodiment of the invention, it is to be distinctly understood that the invention is not limited thereto, but may be otherwise variously embodied within the scope of the following claims:

I claim:

1. In combination:

a miter joint comprising two mitered pieces, each piece having front and back surfaces, two sides and a mitered end surface, the mitered end surfaces of the pieces being in abutting relationship and forming a common joint line, the back of each piece defining at least two pin-receiving holes perpendicular to the back surface and at equal distances from the joint line, the holes in each piece being so located that a line between corresponding holes in the two pieces is perpendicular to the joint line; and a clamp comprising first and second members mounted on a common cylindrical shaft for relative movement toward and away from each other in the axial direction of the shaft, first and second sets of parallel coextensive pins mounted on the first and second members respectively and so oriented as to define first and second planes perpendicular to the axis of the shaft, and means for applying force in the axial direction of the shaft to move the first and second members toward each other and to hold the members in axial position with respect to each other, wherein the first set of pins is received in the holes in the first mitered piece and the second set of pins is received in the holes in the second mitered piece.

* * * * *